United States Patent [19]

Baker et al.

[11] Patent Number: 4,506,760

[45] Date of Patent: Mar. 26, 1985

[54] SELF-CONTAINED EMERGENCY ESCAPE DEVICE

[76] Inventors: Charles L. Baker, 2900 Oakwood Oaks; Mickeal Mannino, 3590 Lake George Rd., both of Lake Orion, Mich. 48035

[21] Appl. No.: 637,804

[22] Filed: Aug. 6, 1984

[51] Int. Cl.[3] ..... A62B 1/14

[52] U.S. Cl. ..... 182/5; 188/65.4

[58] Field of Search ..... 182/5, 6, 7, 72, 73, 182/240; 188/65.4, 65.5

[56] References Cited

U.S. PATENT DOCUMENTS

| | | | |
|---|---|---|---|
| 133,870 | 12/1872 | Marshall . | |
| 289,304 | 11/1883 | Pealer | 188/65.4 |
| 394,502 | 12/1888 | Nutting . | |
| 485,954 | 11/1892 | Lester . | |
| 643,575 | 2/1900 | Walker et al. | 182/7 |
| 814,458 | 3/1906 | Kramer | 188/65.5 |
| 930,580 | 8/1909 | Weinstock | 188/65.5 |
| 1,035,176 | 8/1912 | Fine | 188/65.4 |
| 1,158,952 | 11/1915 | Amman . | |
| 1,198,926 | 9/1916 | Kemp . | |
| 1,413,690 | 4/1922 | Slocum | 188/65.5 |
| 1,896,415 | 2/1933 | Pyles . | |
| 4,024,927 | 5/1977 | Sheppard . | |
| 4,114,726 | 9/1978 | Sentinella . | |
| 4,223,761 | 9/1980 | Sonnberger . | |

*Primary Examiner*—Reinaldo P. Machado

*Attorney, Agent, or Firm*—Martin P. Hoffman; Stewart L. Gitler; Mitchell B. Wasson

[57] ABSTRACT

A self-contained emergency escape device includes a first larger jaw, a second smaller jaw, a bolt mounting the jaws for relative movement, a yoke defined at the upper end of the first jaw, and a take-up spool secured within said yoke. Several brake plugs are secured to the interior edges of the jaws, and complementary cut-outs are defined in the opposing edges of the jaws. A sturdy cable is an integral part of the escape device, and extends through the device in a tortuous path extending over the brake plugs and subsequently being stored, when not in use, on the spool. A sling is secured to the jaws so that the user can not be separated from, or fall away from, the emergency escape device. Also, a fail-safe mechanism prevents the jaws from being forced too far apart. One uses the device by applying manual pressure to the jaws to increase the frictional resistance on the cable and thus controlling the rate of descent.

10 Claims, 6 Drawing Figures

SELF-CONTAINED EMERGENCY ESCAPE DEVICE

FIELD OF THE INVENTION

This invention relates to a self-contained portable fire escape device for controlling the user's rate of descent along a rope, cable or other strand while fleeing from a fire, or other emergency conditions.

BACKGROUND OF THE INVENTION

Fire escape devices are utilized for descending a vertical strand, such as a rope or cable, to enable users to lower themselves down the sides of buildings when trapped on upper stories during a fire. Various devices allowing for slow descent when applied to a vertical strand have been used to facilitate evacuation during a fire or other emergency. Representative fire escape devices are depicted in U.S. Pat. No. 4,223,761, Sonnberger; U.S. Pat. No. 4,114,726, Sentinella; and U.S. Pat. No. 1,198,926, Kemp.

Such devices act as brakes when descending down a rope or other vertical strand which has been provided for an emergency egress from an upper story of a building. The devices slide along the rope with various braking systems incorporated therein to slow the rate of descent by applying frictional forces to the rope.

These prior art devices, however, have proven ineffective in situations where time is of the essence for an easy escape. To illustrate, potential users may encounter difficulty in locating a rope, or cable, of sufficient strength and length to support the potential user; also, under emergency conditions, previously stored escape ropes and the like may be situated in inaccessible locations. Only the device shown in U.S. Pat. No. 1,896,415, Pyles, incorporates a strand into the escape device. However, none of the prior art emergency escape devices known to the inventors combine all of the advantages of the preferred self-contained embodiment of the instant invention. Additionally, serious, even life-threatening problems have occurred with known emergency escape devices when the user has lost his grip of the controls for the braking device. All of these disadvantages of the conventional emergency escape devices have been remedied by the instant invention with resultant benefits to the prospective users.

SUMMARY OF THE INVENTION

With the operational shortcomings of the conventional emergency escape devices clearly in mind, the instant emergency escape device is a self-contained unit which incorporates the rope or cable used for descent directly into the device. Also, the emergency escape device utilizes a safety harness that allows the user to remain with the device, even if the user loses his grip on the handles of the device. A fail-safe nut prevents the handles from separating too far apart, and thus prevents the user from descending too rapidly and injuring himself. Additionally, the rope follows a tortuous path through the body of the device, and a plurality of brake plugs provides a large surface area over which frictional forces are applied to the rope to control the rate of descent.

The instant emergency escape device is relatively inexpensive to fabricate, is simple in design and is susceptible of operation with one hand, and is extremely reliable because of its innovative design. The device is readily portable, and can be stored in tight quarters on balconies or near windows, unlike bulky ladders and escape chutes. While the emergency escape device may find its greatest utilization under emergency conditions, such as fire, the device can be used for mountain climbing, construction work, and similar activities.

Numerous other functional advantages realized by the instant emergency escape device will become readily apparent to the skilled artisan from the appended drawings and ensuring description of the invention.

BRIEF DESCRIPTION OF THE DRAWINGS

Referring now to the drawings, wherein similar parts are identified by the same reference numeral throughout, a preferred embodiment of the invention is illustrated in FIGS. 1–6 wherein.

DESCRIPTION OF THE PREFERRED EMBODIMENT

Figure 1:
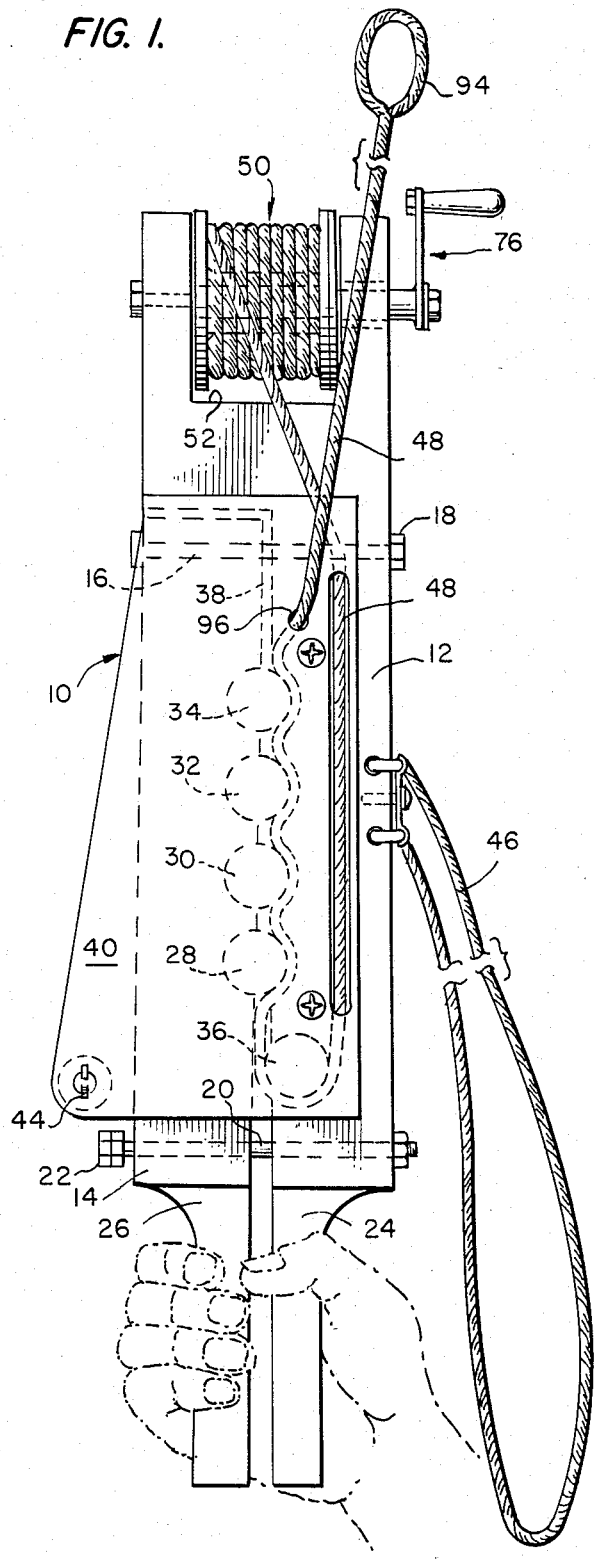
FIG. 1 is a front view of the instant emergency escape device constructed in accordance with the principles of the invention.
Figure 2:
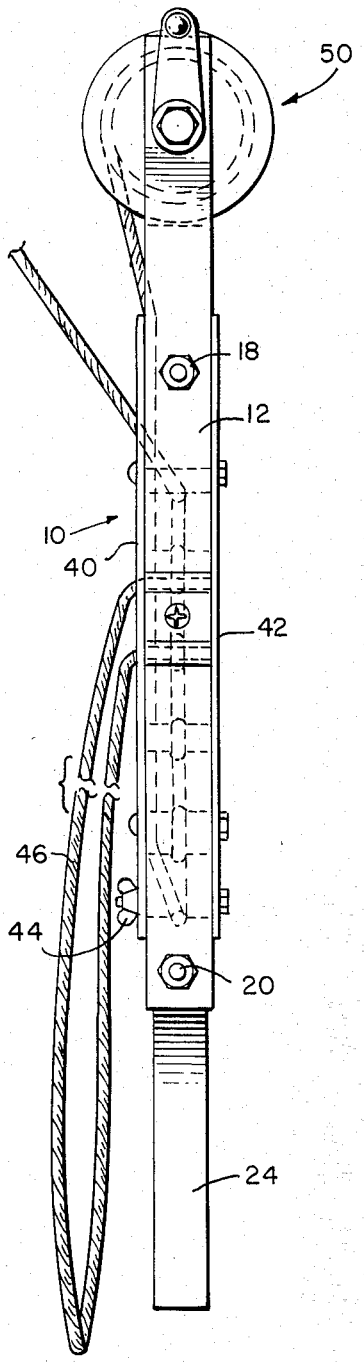
FIG. 2 is a side view of the device shown in FIG. 1.

Referring now to the drawings, FIGS. 1–2 illustrate the emergency escape device 10 embodying the invention. Device 10 comprises a first larger jaw 12 and a second, smaller cooperating jaw 14. A first bolt 16 extends through a passage in both jaws, and a nut 18 is secured to the free end of the bolt 16. A second bolt 20 extends parallel to bolt 16 through an opening in both jaws, and a jam nut 22 is secured to the free end of bolt 20. A grip 24 is formed at the lower end of jaw 12, and a grip 26 is formed at the lower end of jaw 14. By applying manual pressure to the grips 24,26, as by squeezing same together as suggested in FIG. 1, the jaws move toward each other along the bolts 16,20.

Several brake plugs 28,30,32,34 and 36 are disposed along the internal edges of jaws 12,14. Plugs 28,30,32 and 34 are secured to jaw 14, and project laterally toward corresponding semi-circular cutouts defined in the internal edge of jaw 12. Plug 36 is secured to jaw 12 and projects laterally toward jaw 14. An inverted, L-shaped channel 38 is defined between jaws 12,14, as best seen in FIG. 1.

FIG. 2 reveals that metallic cover plates 40,42 have been secured by rivets, screws, or the like to opposite faces of device 10 to strengthen same and to properly position the brake plugs therebetween. A spacer plug 44 supports the two plates in the area where the plates project beyond the body of the jaws 12,14. A rope sling, or web harness, 46, is permanently secured to jaw 12; the sling can be fitted about the body of the user of the device 10.

Figure 3:
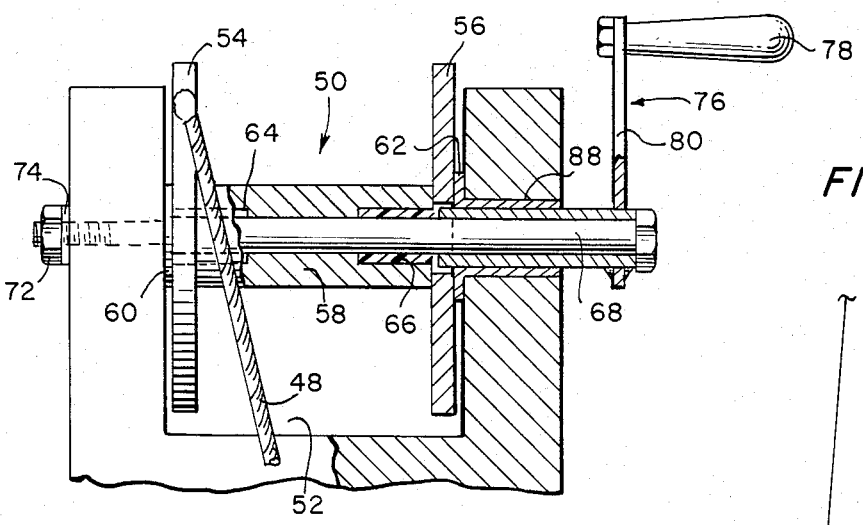
FIG. 3 is a side, fragmentary sectional view of the spool and crank of the device, such view being taken on an enlarged scale.
Figure 4:
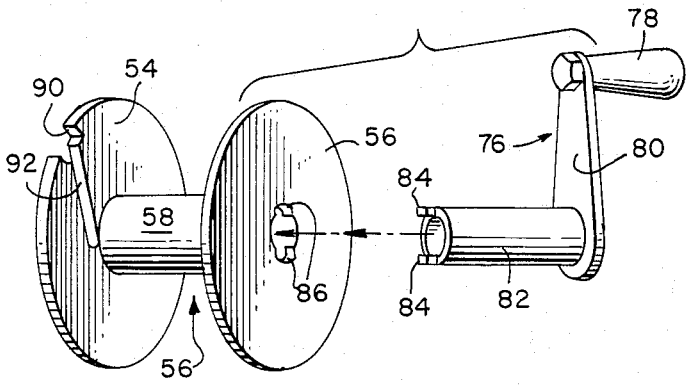
FIG. 4 is an exploded perspective view of the spool and crank of the device.

A sturdy cable 48 passes, in a tortuous fashion, through the body of device 10. Prior to use, the bulk of the cable is stored upon spool 50 situated in the opening of a yoke 52 defined at the upper end of device 10. Spool 50, as best shown in FIGS. 3 and 4, comprises a first end plate 54 and a second end plate 56 spaced apart from each other along spool core 58. The plastic washer 60 spaces end plate 54 from one wall of the yoke 52, while a second plastic washer 62 spaces end plate 56 from the opposing wall of the yoke 52. A low friction bushing 64 is situated adjacent end plate 54, while a similar low friction bushing 66 is situated inboard of the opposing end plate 56. A central shaft 68 extends axially through the walls defining the yoke and through the core 58 extending between end plates 54 and 56. A nut 72 and a pressure washer 74 retain shaft 68 in fixed position.

A crank mechanism 76 extends beyond one wall of the yoke 52. The crank mechanism comprises a handle 78, a vertical link 80, and a horizontally extending tube 82. Two or more dogs 84 are formed at the free end of tube 82, and the dogs fit within slots 86 defined in the end plate 56. Horizontal tube 82 fits over shaft 68 but within bushing 88. By manually applying a rotational torque to handle 78, the crank mechanism drives core 58 relative to fixed shaft 68 and gathers the cable on spool 50.

One end of cable 48 is soldered, or otherwise secured, to a notch 90 in the slot 92 formed in end plate 54. A loop 94 is formed at the opposite end of cable 48; the loop 94 fits around an anchor or other fixed point.

The tortuous path that cable 48 traverses in passing through device 10 is best shown in FIG. 1. Starting from loop 94, cable 48 enters an opening 96 and passes into the interior of device 10 defined between cover plates 40,42. The cable passes about brake plugs 34,32,30, 28, and 36, in sequence, and then travels onto spool 50. By rotating crank mechanism 76 in the appropriate direction, most of the cable is gathered thereon for storage, when not in use.

Figure 5:
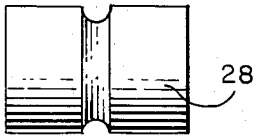
FIG. 5 is a detail view of one of the brake plugs used within the emergency escape device.

FIG. 5 shows the constructional details of one of the brake plugs. The plugs, which are identical in shape and function, are cylindrical in shape with a central recess of sufficient depth to enable cable 48 to be retained therein, without lateral slippage, during its travel through device 10.

Figure 6:
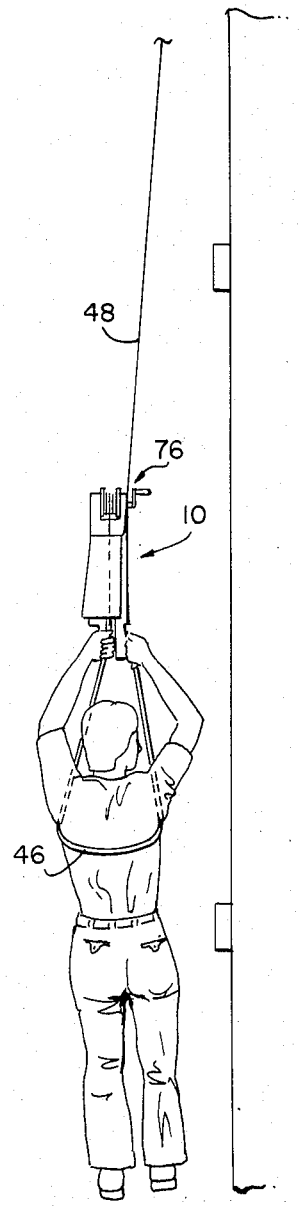
FIG. 6 is a schematic illustration of the manner of using the emergency escape device.

FIG. 6 schematically depicts the emergency escape device 10 in operation. Under emergency conditions, the user secures loop 94 about an anchor (not shown) adjacent to a window, and then fastens sling 46 about his body. The user than exits through a window, and lowers himself to lower floors within the building, or to the ground, by applying manual pressure to grips 24,26. As the grips are moved toward each other, frictional resistance imparted to cable 48 as it passes around the several brake plugs is increased. The greater the frictional resistance, the slower the rate of descent.

In the event that the user should lose his hold on the grips, jam nut 22 prevents the jaws from being spread too far apart, thus precluding a sudden, and potentially harmful, increase in the rate of descent. Such fail-safe feature enhances the safety of the emergency escape device 10.

Numerous structural revisions and modifications to the preferred embodiment of this device will occur to the skilled artisan after reviewing the foregoing specification, which is illustrative in nature.

For example, the brake plugs may be formed without central recesses, or the recesses may be even deeper to accommodate a heavy rope. The number of brake plugs may be varied, and the location of the complementary cut-outs in the opposing jaw may be altered, provided that the proper level of frictional resistance can still be supplied upon the cable 48 or rope.

Consequently, the appended claims should not be limited narrowly to their expressed terms, but should be construed in a liberal manner consistent with the breadth and scope of the instant, unique self-contained emergency escape device.

We claim:

1. A self-contained, emergency escape device comprising:

(a) a first, larger jaw, (b) a second, smaller cooperating jaw, (c) a first grip formed at the lower end of said first jaw and a second grip formed at the lower end of said second jaw, (d) means mounting said jaws so that said jaws can be moved relative to one another, (e) a sling secured to one of said jaws and adapted to be positioned about the body of a user of the device, (f) a yoke defined at the upper end of said first jaw, (g) a take-up spool mounted within said yoke, (h) brake means mounted on one of said jaws and complementary recesses defined in the opposing jaw, (i) a cable extending between the jaws in a tortuous path passing over said brake means, (j) one end of said cable being adapted to be secured to an anchor point from which a descent is to be made, and (k) the opposite end of said cable being secured to said take-up spool and the bulk of said cable being wound upon said spool prior to use, whereby, (l) said jaws are moved closer together when manual pressure is applied to said grips to increase the frictional forces exerted upon the cable, thus varying the rate at which said cable is unwound from said take-up spool during operation.

2. The emergency escape device of claim 1 further including means for limiting the relative movement of said jaws away from one another, thereby preventing said cable from being unwound from said spool at an excessive rate.

3. The emergency escape device of claim 2 wherein said means for limiting relative movement comprises a bolt extending laterally through said first and second jaws, and a jam nut secured to said bolt.

4. The emergency escape device of claim 1 wherein said brake means comprises a plurality of cylindrical brake plugs, each plug having a central recess to receive the cable therewithin.

5. The emergency escape device of claim 1 wherein a first cover plate is secured to one side of the device and a second cover plate is secured to the opposite side of the device, said cover plates firmly retaining said brake means in fixed position.

6. The emergency escape device of claim 5 wherein a spacer plug is secured between said cover plates to maintain same in proper position.

7. The emergency escape device of claim 5 wherein an opening is formed in one of said cover plates, said opening permitting said cable to pass inwardly into contact with said braking means.

8. The emergency escape device of claim 1 further including a manually operable crank mechanism for rotating said spool to rewind said cable thereupon.

9. The emergency escape device of claim 8 wherein said crank mechanism includes a handle, a vertical link, and a hollow tube with dogs defined at one end thereof, said dogs delivering a rotational force to said spool when the handle is rotated.

10. The emergency escape device of claim 1 wherein said means for mounting said jaws for relative movement comprises a horizontally extending bolt passing through both of said jaws above their midpoints.

* * * * *

UNITED STATES PATENT AND TRADEMARK OFFICE

CERTIFICATE OF CORRECTION

PATENT NO. : 4,506,760

DATED : March 26, 1985

INVENTOR(S) : Baker et al

It is certified that error appears in the above-identified patent and that said Letters Patent is hereby corrected as shown below:

On the front page, Column 1, line 76, the word "Oakwood" should actually be --Oakland--.

Signed and Sealed this

*Ninth* Day of *July 1985*

[SEAL]

*Attest:*

DONALD J. QUIGG

*Attesting Officer* *Acting Commissioner of Patents and Trademarks*